United States Patent [19]

Engeriser

[11] 3,946,663

[45] Mar. 30, 1976

[54] POWER EMBOSSING APPARATUS

[76] Inventor: Charles Engeriser, 7704 W. Giddings, Chicago, Ill. 60656

[22] Filed: Apr. 1, 1974

[21] Appl. No.: 456,670

[52] U.S. Cl. ..... 101/3 R; 197/6; 101/245

[51] Int. Cl.[2] ..... B44B 5/00

[58] Field of Search ..... 101/3 R, 3 SP, 26–28, 101/32, 232–235, 245; 197/6, 6.3

[56] References Cited

UNITED STATES PATENTS

| | | | |
|---|---|---|---|
| 1,108,518 | 8/1914 | Putnam | 197/6 X |
| 1,203,113 | 10/1916 | Henry, Jr. | 101/3 R |
| 1,301,890 | 4/1919 | Winter | 101/3 R |
| 1,898,782 | 2/1933 | Littlefield | 101/3 R |
| 1,974,753 | 9/1934 | Robbins | 101/3 R X |
| 2,043,246 | 6/1936 | Hawkes | 101/3 R |
| 2,088,428 | 7/1937 | McClure | 101/3 R X |
| 2,092,816 | 9/1937 | Stacey | 101/3 R |
| 2,108,850 | 2/1938 | Fromm | 101/3 R X |
| 2,621,842 | 12/1952 | Burdin | 101/3 R |
| 3,016,006 | 1/1962 | Schroter | 101/3 R |
| 3,636,866 | 1/1972 | Stommel et al. | 101/22 |

FOREIGN PATENTS OR APPLICATIONS

| | | | |
|---|---|---|---|
| 883,801 | 12/1961 | United Kingdom | 101/3 R |
| 648,542 | 9/1962 | Canada | 101/3 R |
| 300,616 | 8/1954 | Switzerland | 101/3 R |
| 133,435 | 8/1920 | United Kingdom | 101/3 R |

*Primary Examiner*—Edgar S. Burr
*Assistant Examiner*—Edward M. Coven
*Attorney, Agent, or Firm*—Olson, Trexler, Wolters, Bushnell & Fosse, Ltd.

[57] ABSTRACT

The embodiment of the invention disclosed herein is directed to power embossing apparatus which has support means for holding one die in a fixed position and a linearly movable ram for holding a second die to be moved toward and away from the first die. To insure flow of the sheet material being embossed, the dies are held together in their pressure-applying position for a predetermined dwell period of time during the embossing operation. The dies are also held apart during a predetermined dwell period of time to enable switch means to be actuated to deenergize the power embosser. The dwell periods are obtained by a particular cam surface configuration.

14 Claims, 5 Drawing Figures

POWER EMBOSSING APPARATUS

BACKGROUND OF THE INVENTION

This invention relates generally to embossing apparatus, and more particularly to power embossing apparatus which is operated by a drive motor.

Embossing apparatus is well-known for the purpose of placing an embossed seal on the surface of sheet materials such as legal documents or other paper documents. The seal can take the form of a notary public seal, a state seal, or a corporate seal depending on the particular purpose of use. When placing an embossed seal on documents, a hand-operated device can be used when only a limited number of embossed seals are desired. However, when embossing large numbers of documents, such as is common practice in state and federal government offices, the hand embossing operation becomes time-consuming and tedious.

To overcome the drudgery of such embossing operations, power embossing apparatus have been developed. However, prior art power embossing apparatus are generally deficient in that they can properly emboss only a limited number of sheets of paper at a given time because of the operating nature of the embossing dies. These prior art apparatus generally apply greater embossing pressure at one periphery of the die and less embossing pressure at the other periphery of the die. Therefore, when varing the thickness of the material therebetween, either by thicker material or by a plurality of sheets, the quality of the embossed seal applied to the sheet material is somewhat reduced. One example of a prior art power embosser is illustrated in U.S. Pat. No. 3,033,106, however upon comparison of the present invention to that embosser disclosed therein, it can be readily appreciated that a distinct advance has been effected. Not only is this prior art embosser subject to the above discussed disadvantages, but employs a relatively complex operating mechanism which requires that the drive motor be operating at all times when the machine is turned on. Not only is this device complex in construction but is expensive to manufacture and maintain in service. As will be apparent from the following description, the present invention provides more reliable, simpler and less costly apparatus, than that of said prior art patent.

SUMMARY OF THE INVENTION

Accordingly, it is an object of this invention to provide new and improved power embossing apparatus which applies uniform pressure to embossing dies so that a plurality of sheets of material can be embossed simultaneously with uniform quality of the embossment through the seal.

Another object of this invention is to provide a power embossing apparatus which maintains the embossing dies in a pressure-applying position for a predetermined dwell period of time during the cycle of operation to allow flow of the sheet material within the mating characters of the die to form a more uniform embossed character.

Briefly, the embossing machine of this invention employs a pair of spaced apart embossing dies relatively linearly movable toward and away from one another by means of a vertically movable ram secured to a frame structure on a support base. The vertically movable ram is connected to a pivotal arm which, in turn, has a cam surface formed therein to engage a cam which is eccentrically mounted to an energizing motor. The arm is secured to the linearly movable ram by an adjustable coupling so that the relative pressure applied to sheet material between the dies can be adjusted. The pivotal movement of the arm is absorbed or eliminated by a relatively loose coupling between the end of the arm and the adjustable coupling on the ram.

Many other objects, features and advantages of this invention will be more fully realized and understood from the following detailed description when taken in conjunction with the accompanying drawings wherein like reference numerals throughout the various views of the drawings are intended to designate similar elements or components.

DETAILED DESCRIPTION OF THE ILLUSTRATED EMBODIMENT

Figure 1:
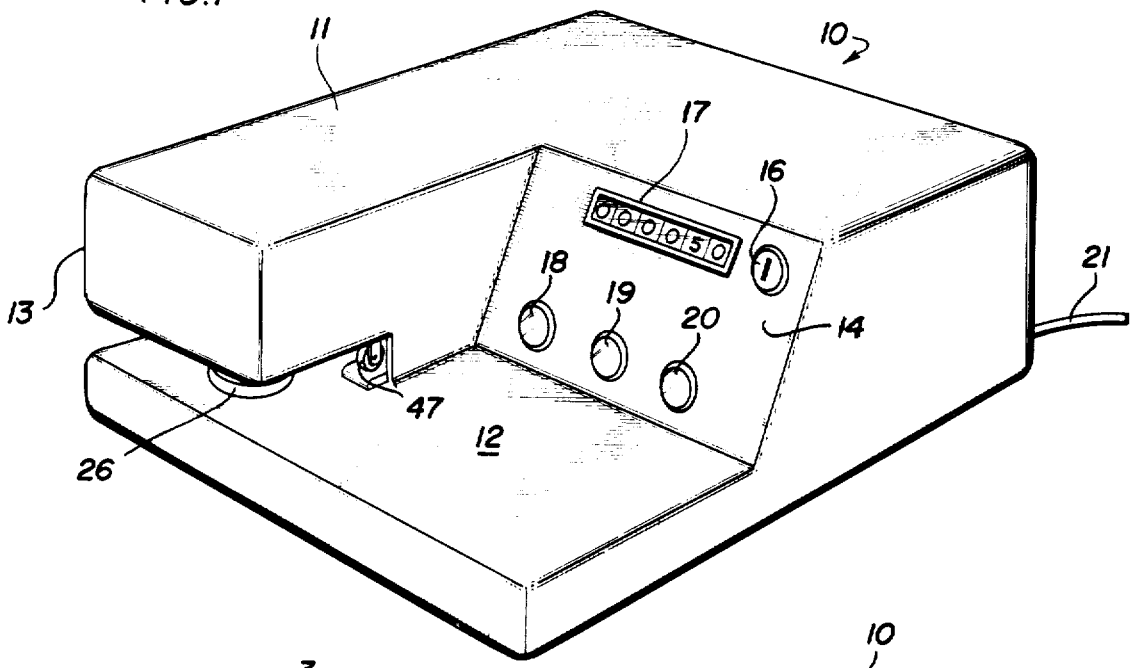
FIG. 1 is a perspective view illustrating a power embosser constructed in accordance with the principles of this invention.

Referring now to FIG. 1, an embossing machine which is designated generally by reference numeral 10, and constructed in accordance with the principles of this invention is shown. The embossing machine 10 has an outer casing 11 which covers the drive motor and frame structure which are secured to the support base located thereunder. The outer casing 11 has a smooth surface area 12 which allows sheet material such as paper and the like easily to be slid between the smooth surface 12 and a cantilever portion 13.

A pair of spaced apart embossing dies are located between the smooth surface and the cantilever portion. In addition, a control panel portion 14 is provided on the outer casing 11 and includes a security lock device 16, such as a key lock or the like, to operate switch means for energizing the power embosser. Therefore, only authorized personnel, those who have the proper key, can energize the embosser for use.

To keep track of the number of operating cycles of embossing that the machine has performed, a digital counter 17 is provided on the panel 14. Most advantageously, this counter has a memory so that power failures will not affect the number displayed.

To provide signal means relating to the operation or function of the embossing machine, three indicating lights are located on the front panel. A first light 18 is utilized to indicate that power is applied and the embossing machine is energized by actuation of the switch 16. This therefore indicates that the embossing machine is in readiness for operation. A second light 19 is utilized to indicate that an embossing cycle of operation is under way and paper should not be inserted or removed during this time. The third light 20 is utilized to indicate the completion of operation of the embossing cycle so that paper can be removed from between the smooth surface 12 and the cantilever portion 13. A power cable 21 enters the embossing machine through the rear of the cabinet 11 and is adapted for connection to any suitable source of power. For example, a source of alternating current voltage of 110 volts can be utilized.

Figure 2:
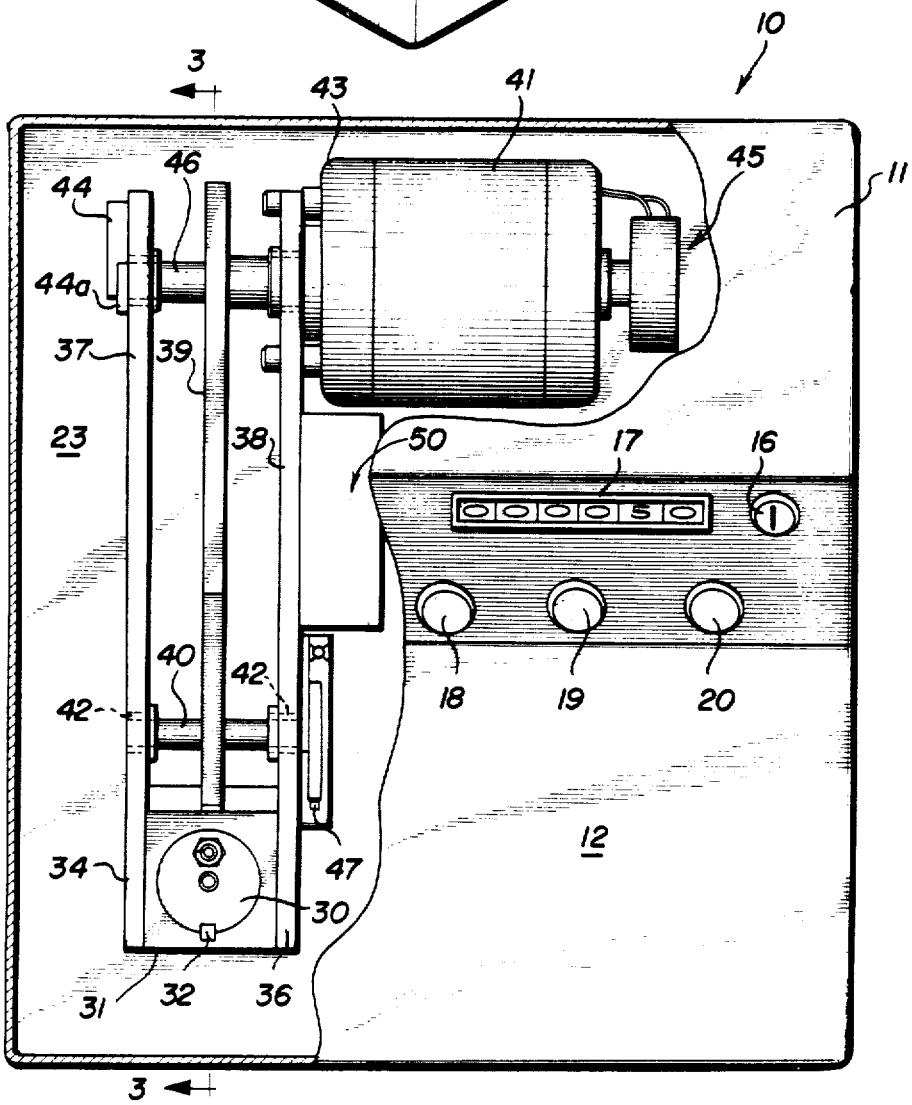
FIG. 2 is a plan view of the power embosser of FIG. 1 with portions of the outer casing broken away to illustrate the mechanism located therein.
Figure 3:
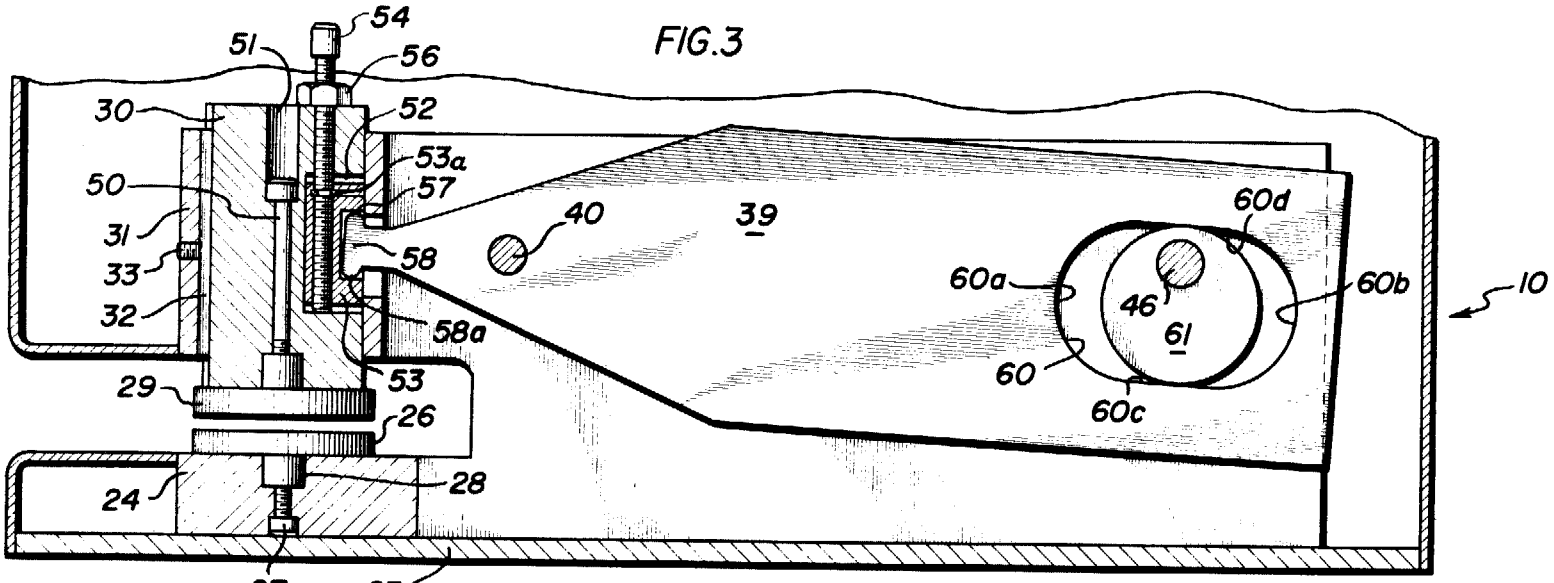
FIG. 3 is a sectional view taken along line 3—3 of FIG. 2 and illustrates the power embosser in its normally open position in readiness to receive sheet material to be embossed.
Figure 4:
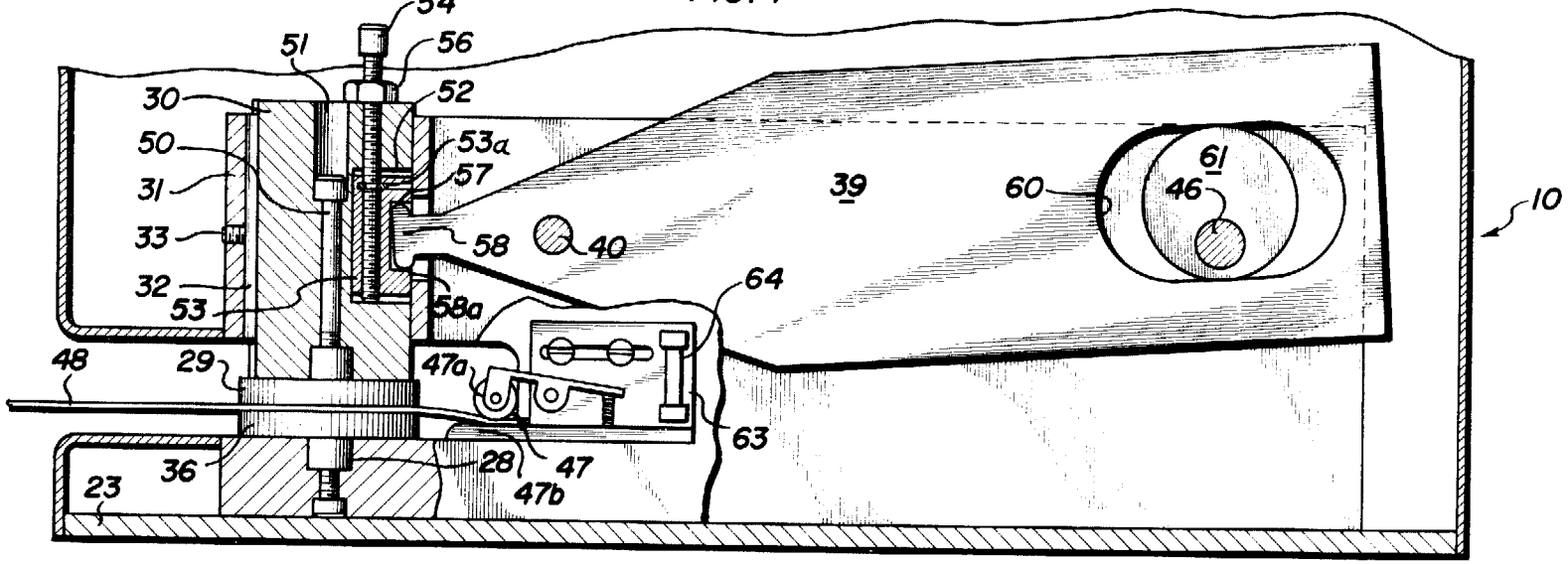
FIG. 4 is a sectional view substantially similar to that of FIG. 3 but with the power embosser illustrated in the actuated position for embossing sheet material.

Referring now to FIGS. 2, 3 and 4 the interior construction of the embossing machine 10 is shown, the elements thereof being mounted upon a base plate member 23 which may be constructed of aluminum. A mounting or support block 24 is secured to the base plate to receive one die element 26. The die 26 is secured to the block 24 by means of a socket head screw 27 which, in turn, engages a boss 28 extending from the die, as best seen in FIGS. 3 and 4. A second die element 29 is secured to a vertically movable ram 30 which, in turn, is limited to linear movement by slidable mounting within a ram guide 31. The ram guide 31 is formed of a machined block of metal, which may be steel or the like, and includes a guide key 32 which is held in place by a set screw 33 and disposed in a keyway formed in said ram 30 thereby maintaining linear alignment of the ram and ram guide.

The ram guide 31 is secured to cantilever portions 34 and 36 of a pair of frame members 37 and 38, respectively. The frame members 37 and 38 are rigidly supported and spaced apart to pivotally support an arm member 39 therebetween. The arm member 39 pivots about a pivot pin 40 as it is actuated by a drive motor 41. The pivot pin 40 is secured to the frame members 37 and 38 by means of bronze bushings, or the like, placed on opposite sides thereof and designated by reference numeral 42. The drive motor 41 has a gear reducing end portion 43 and a brake 45 located at the other end of the motor. The brake 45 is actuated to hold the motor in a braked condition when power is released from the brake and from the motor. Upon energizing the motor with electrical power, the brake automatically releases to enable rotation of the output shaft. A microswitch 44 is actuated by the output shaft of the motor, preferably by the cam associated therewith, so as to enable electronic circuitry to start a timing sequence. This then insures that the vertical ram position is obtained at the end of each embossing cycle of operation.

The paper actuated initiation switch 47 is located slightly above the smooth surface 12 and behind the embossing dies 26 and 29 so that a sheet of paper can be inserted between electrical contacts forming the switch. The electrical contacts are formed by the roller member 47*a* and the flat contact member 47*b* so that electrical current passes therethrough during an initial condition of operation of the embossing machine. When the sheet material 48 is inserted between the roller member 47*a* and the plate member 47*b*, the contact is broken and energization of the motor 41 is obtained. Contacts 47*a* and 47*b* are considered an initiation switch arrangement which can be actuated by relatively thin and lightweight sheet material. However, it will be understood that other switch means, such as microswitches or the like, can be used for an initiation switching circuit.

Figure 5:
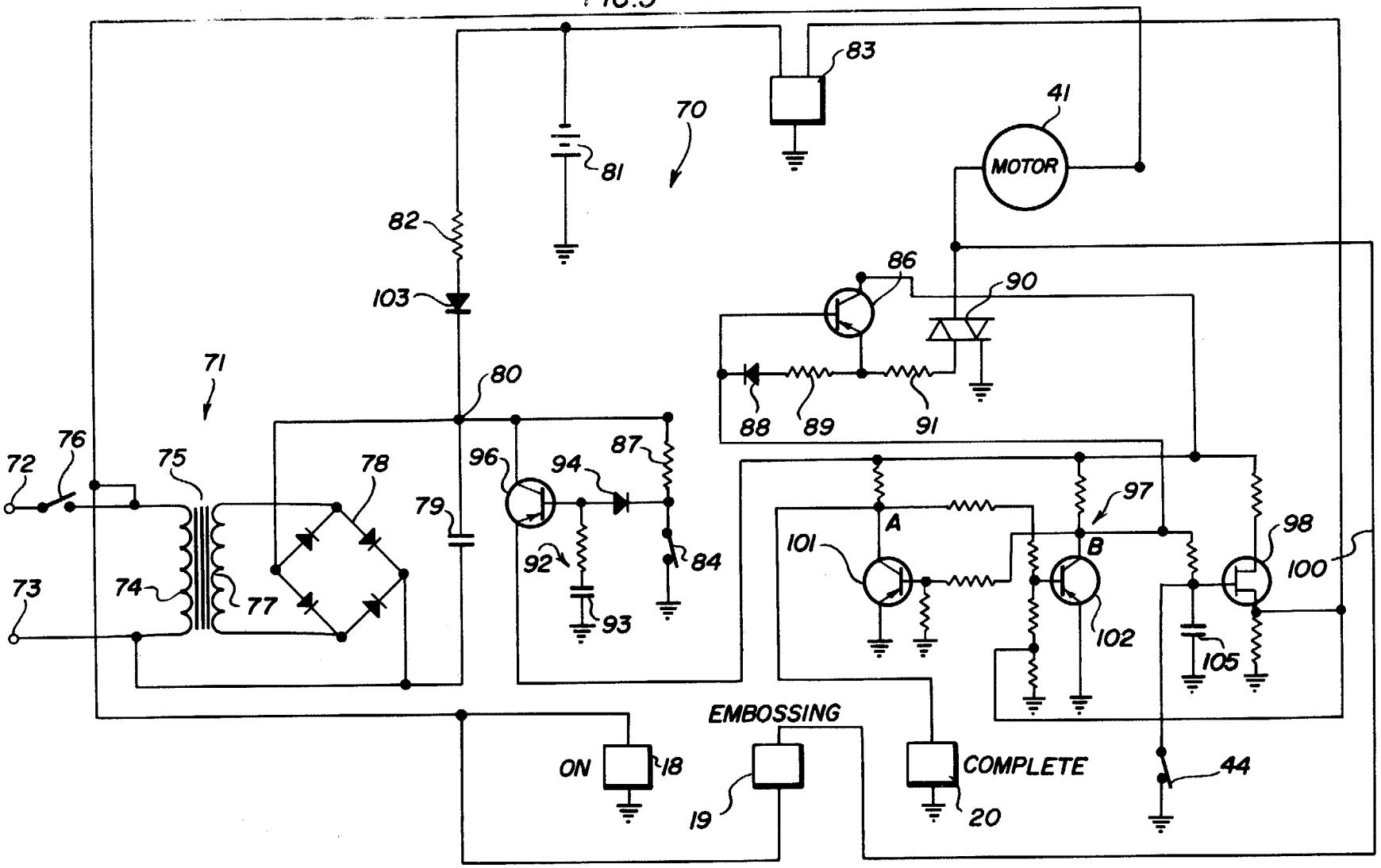
FIG. 5 is a schematic diagram illustrating the circuit which is utilized to operate the power embosser of this invention.

The electronic circuitry necessary for operation of the embosser 10, and most particularly the motor 41 together with its magnetic brake is mounted on a printed circuit board indicated generally by reference numeral 50. The electronic components located on the circuit board 50 are illustrated by the schematic of FIG. 5, which will be discussed hereinafter. It will be understood that other circuit configurations can be utilized without departing from the novel concepts of this invention.

Referring once again to FIGS. 3 and 4, the ram 30 holds the die 29 by means of a socket head screw 49 extending into an aperture 51. A cutout portion 52 is provided in the ram and receives a threadedly adjustable slide member 53 which is in engagement with an adjusting element 54. Here, the adjusting element 54 is a threaded machine screw which has a lock nut 56 located at the top portion thereof. The adjusting element 54 is held captive in the adjusting block 53 by a C-shaped washer element 53*a*. It will be understood that other suitable locking means may be incorporated to hold the adjusting element 54 in position. The adjustable member 53 has a recess 57 which receives a tab or cam portion 58 of the pivotally mounted arm 39. The arcuate movement of the arm 39 is transferred to linear movement of the ram 30 by allowing slight relative movement or slippage between the tab or cam portion 58 and the recess 57. This is best seen by comparison of the two positions shown in FIGS. 3 and 4. To facilitate this relative movement, the cam portion 58 is round, as indicated at 58*a*.

A cam follower surface 60 is formed within the arm 39 and receives a cam 61 secured to the output shaft 46 in a manner as illustrated in FIGS. 3 and 4. When the cam 61 is in the position shown in FIG. 3, the dies 26 and 29 are separated, and the embossing machine 10 is in readiness to receive sheet material for embossing. This position will start the deenergization sequence of the motor 41 by actuation of the microswitch 44, FIG. 2.

Most advantageously, the cam surface 60 is formed by a pair of diametrically opposed semicircular surface portions 60*a* and 60*b* and a pair of parallel spaced apart straight surface portions 60*c* and 60*d*. The semicircular portions 60*a* and 60*b* provide clearance for the cam 60. The cam 60 is shaped to provide the necessary dwell at both the top and bottom positions of the ram 30. When sheet material is placed between the embossing dies 26 and 29 and break contact between the roller 47*a* and plate 47*b* of the paper switch 47, the motor 41 is energized and the cam 61 will begin to rotate. This action will start pivotal movement of the arm 39 to move the ram 30 and die member 29 downward. When the arm 39 is in the embossing position, FIG. 4, thereby urging the die elements 26 and 29 together to form an embossment on sheet material, the cam 61 and cam surface 60 will maintain the arm in this position for a short period, thereby allowing sufficient time for the sheet material between the dies to flow and form a more uniform embossment. As the cam 61 continues to rotate through this arcuate section, it again engages the linear portions of surface 60 and pivots the arm 39 to raise the ram 30 and die 29. As the cam 61 continues its rotation and approaches the second arcuate portion of surface 60, it will maintain the arm 39 in a relatively fixed position at the top of the stroke of the ram, FIG. 3. At this time the microswitch 44 will be actuated by the cam 44*a* to start the deenergization sequence of the system.

One of the features of the present invention is that the C-shaped portion of the frame members 37 and 38 that form the cantilever 13 will bend or flex somewhat during the pressure applying portion of the operation cycle. This action will prevent the paper, or other sheet material, from tearing should it be relatively thick. In the illustrated embodiment the C-shaped portions will flex about one-half of the thickness of the sheet material being embossed.

The actuating switch 47, which is responsive to the presence of sheet material, may be placed on an adjusting block 63 which, in turn, may carry a fuse element 64. The fuse 64 is a protection device for the electronic circuitry.

For a better understanding of the electronic circuitry associated with the embossing machine of this invention, reference is now made to FIG. 5 which illustrates the electronic components that are mounted on the printed circuit board 50. The circuit is here designated generally by reference numeral 70. Here the electronic circuit 70 includes a power supply 71 which receives alternating current voltage from a pair of input terminals 72 and 73 and applies this alternating current voltage to the primary winding 74 of a power transformer 75 via an on/off switch 76. The on/off switch 76 corresponds to the key switch 16. A secondary winding 77 of the power transformer is coupled to the AC input terminals of a bridge rectifier network 78 which, in turn, has the DC output terminals thereof connected to a filter capacitor 79. It will be understood that other filtering elements may be incorporated in the power supply such as choke or resistance means. The filter capacitor is connected to a DC power supply terminal point 80 which also has a battery source 81 connected thereto through a resistance element 82. The battery source 81 may be utilized to maintain a memory condition on a digital readout counter 83 if desired. The digital counter 83 is connected to the battery supply 81 and to the terminal 80 through resistor 82 and diode 103 for operation from both the developed DC voltage source and from the DC voltage of the battery. Also, the developed DC voltage may be used to maintain the battery in a fully charged condition. The diode 103 is used to prevent battery drain through the circuit when the DC potential applied to terminal 80 is off.

The paper actuated switch is here designated generally by reference numeral 84 and applies ground potential to the base emitter junction of transistor 96. Switch 84 corresponds to the initiator switch 47. The paper actuated switch 84 is connected to the DC circuit point 80 through a resistor 87.

In operation, opening of the initiation switch 84 will forward bias the base emitter junction of transistor 96. This causes transistor 96 to conduct heavily thus providing DC power to the rest of the components associated with the flip-flop circuit 97 and the unijunction transistor 98. Upon initial application of DC voltage to flip-flop circuit 97, transistor 101 is rendered conductive while transistor 102 is rendered nonconductive. With transistor 102 in the nonconductive state, the collector of transistor 102 is substantially at the positive potential applied to the circuit through transistor 96. This positive potential provides a pulse to the base emitter junction of transistor 86 to render it conductive and apply operating potential to a bidirectional silicon controlled rectifier switching device 90. This will render the motor 41 operative.

The initial actuation of switch 84 also applies a pulse to the unijunction transistor 98. As long as the flip-flop circuit 97 is in the initial state with transistor 101 conductive and transistor 102 nonconductive, the motor 41 is activated and the braking mechanism is held off. Also during this time the indicating light 19 is on and unijunction transistor 98 is conductive. When the embossing cycle of operation is approximately 80% complete, the cam **44*a* engages the microswitch 44 and removes ground potential from the emitter junction of the unijunction transistor. This allows the unijunction transistor timing capacitor 105 to charge. Upon completion of the charging cycle, the unijunction transistor 98 sends a pulse to the counter 83 and to the base electrode of transistor 102 of the flip-flop circuit 97. This action will render transistor 102 conductive and transistor 101 nonconductive to place the flip-flop circuit in a second stable state. With flip-flop circuit 97 in the second state, the collector electrode of transistor 102 is substantially at ground potential and transistor 86 is thereby rendered nonconductive which, in turn, turns off the motor 41, the light 19, and prevents retiming of the charging capacitor 105 of the unijunction transistor 98. Also in the second state of the flip-flop circuit 97, the collector of transistor 101 becomes positive thus providing a pulse to activate the complete indicating lamp 20**.

Resistor 92 and capacitor 93 connected in the base electrode of transistor 96 are utilized to prevent rapid firing of the embossing machine. In the illustrated embodiment the value of components 92 and 93 is such that the maximum rate of operating the initiation switch 84 is approximately one-half cycle per second. The diode 88 and resistor 89 are utilized to bias the transistor 86 when the collector electrode of transistor 102 is positive.

While only a single specific embodiment of the novel concepts of the present invention has been illustrated in great detail, it will be understood that variations and modifications may be effected without departing from the spirit and scope of the novel concepts disclosed and claimed herein.

The invention is claimed as follows:

1. An embossing machine comprising in combination: first and second spaced apart die holder means to receive embossing dies for embossing of sheet material place therebetween, support means for supporting said first die holder means in a substantially fixed position, said support means including a base member, parallel spaced apart frame elements secured to said base member and framing a cantilever portion, ram means for movably holding said second die holder means relative to said first die holder means, said ram means being secured to said cantilever portion to carry said second die holder means in a linear motion toward said first die holder means, said cantilever portion including a ram guide, arm means positioned between said spaced apart frame members and pivotally secured thereto intermediate its ends, one end of said arm means being movably coupled to said ram, power drive means coupled to the other end of said ram for selectively moving said ram and said second die holder means toward and away from said first die holder means during an embossing cycle of operation, adjustable coupling means secured to said ram for receiving said one end of said arm and thereby providing means for adjusting the relative pressure exerted to sheet material placed between said first and second die holder means, a closed loop cam surface formed within said arm near said other end thereof, and a cam secured to said power drive means and engageable with said closed loop cam surface for driving said arm through an embossing cycle of operation, said closed loop cam surface providing dwell means for maintaining said first and second die holder means in a close-together position for a predetermined period of time during an embossing operation and for maintaining said die holder means in a spaced apart condition prior to termination of the embossing cycle of operation.

2. The embossing machine as set forth in claim 1 further including actuation means responsive to the presence of sheet material placed between said first and second die holder means to initiate energization of said power drive means.

3. The embossing apparatus as set forth in claim 1 wherein said power drive means includes an arm having one end coupled to said ram means and the other end coupled to said power drive means, pivot means intermediate the ends of said arm, a cam surface formed in said other end of said arm, and a cam connected to a drive motor and engageable with said cam surface to actuate said arm, whereby up and down movement of said ram is obtained during energization of said power drive means.

4. The embossing machine as set forth in claim 1 wherein said cam surface has first and second dwell portions, said first dwell portion utilized to maintain said first and second dies in a close together position during embossing, said second dwell portion utilized to maintain said first and second dies in a spaced apart position during which time switch means is actuated to deenergize said power drive means.

5. The embossing machine as set forth in claim 1 further including switch means secured to said support means and in circuit with said power drive means and adapted to have the actuating member thereof engaged to de-energize said power drive means after each embossing cycle of operation.

6. The embossing machine as set forth in claim 5 further including indicating means for indicating that the power drive means is in readiness to be energized for an embossing operation, and thereafter to indicate that an embossing operation is in progress, and thereafter to indicate that the embossing operation is completed.

7. The embossing machine as set forth in claim 1 wherein said closed loop is formed of an elongated aperture having substantially parallel spaced apart portions joined together by substantially symmetrical semicircular portions.

8. The embossing machine as set forth in claim 1 wherein said cam is substantially round and eccentrically secured to said drive motor.

9. The embossing machine as set forth in claim 1 further including counter means for counting the number of times said power drive means is energized for operating said second die through an embossing cycle of operation.

10. An embossing machine comprising in combination: first and second spaced apart die holder means for receiving embossing dies of the type designed to emboss sheet material placed therebetween; a base support member for fixedly holding said first die holder means; a ram positioned adjacent said base support member with said second die holder means secured thereto, means mounting said ram to produce a ram stroke of relatively linear movement toward and away from said first die holder means; electrically powered drive means including a drive motor which is energized throughout the embossing cycle; means operatively coupling said drive motor to said ram and including means providing for a dwell in the movement of said ram at the upper portion of the ram stroke; control means for energizing said drive means to produce movement of said ram and said second die holder means toward and away from said first die holder means during an embossing cycle, said control means including actuating means responsive to the positioning of sheet material between said first and second die holder means and thereupon supplying power to energize said drive motor and commence the embossing cycle, and means for de-energizing said drive motor upon completion of the embossing cycle, and when said ram is at the upper, dwell portion of the ram stroke, said means for de-energizing the drive motor including a switch in circuit with said drive motor and having an actuator member, and a switch actuating element related to the position of said ram to engage said actuator member upon completion of the embossing cycle thereby to operate said switch and interrupt the supply of power to said drive motor, thereby de-energizing and terminating the embossing cycle automatically after but a single embossing stroke, and with the ram in the upper dwell portion of said ram stroke.

11. An embossing machine as set forth in claim 10 wherein said drive means includes a shaft driven by said drive motor, and said actuating element is carried on said shaft, which shaft makes but a single revolution for each embossing stroke of the ram.

12. An embossing machine comprising in combination: first and second spaced apart die holder means for receiving embossing dies of the type designed to emboss sheet material therebetween; a base support member for fixedly holding said first die holder means; a ram position adjacent said base support member with said second die holder means secured thereto, means confining said ram to relatively linear movement toward and away from said first die holder means, electrically powered drive means and means operatively coupling said drive means to said ram, control means for energizng said drive means to produce movement of said ram and said second die holder means toward and away from said first die holder means during an embossing cycle, said control means including actuating means responsive to the positioning of sheet material between said first and second die holder means and thereupon supply the power to energize said drive motor and commence the embossing cycle, and means for de-energizing said drive means upon completion of the embossing cycle, said means for de-energizing the drive means including a switch in circuit with said drive means and having an actuator member, and a switch actuating element related to the position of said ram to engage said actuator member upon completion of the embossing cycle thereby to operate said switch and interrupt the supply of power to said drive means thus de-energizing and terminating the embossing cycle automatically after but a single embossing stroke, said means for operatively coupling said drive means to said ram, including an arm pivotally secured to said base support member and having one end thereof coupled to said ram, a close loop cam surface formed in the opposite end of said arm and a cam member engageable with said close loop cam surface and rotatably connected to said drive means wherein rotation of said cam in engagement with the cam surface will produce pivoting of said arm and correspondingly, linear movement of said ram.

13. An embossing machine as set forth in claim 12 wherein said closed loop cam surface is of an elongate, oval configuration having a first dwell portion at the bottom of travel of said ram to enable the dies to apply pressure to the sheet material therebetween for a predetermined time interval thereby allowing the sheet material to flow during embossment, and a second dwell portion at the top of travel of said ram to maintain said ram in said starting position at the end of the embossing cycle.

14. An embossing machine comprising in combination: first and second spaced apart die holder means for receiving embossing dies of the type designed to emboss sheet material placed therebetween, a base support member for fixedly holding said first die holder means, a ram positioned adjacent said base support member with said second die holder means secured thereto, means confining said ram to relatively linear movement toward and away from said first die holder means, electrically powered drive means, and means operatively coupling said drive means to said ram, control means for energizng said drive means to produce movement of said ram and said second die holder means toward and away from said first die holder means during an embossing cycle, said control means including actuating means responsive to the positioning of sheet material between said first and second die holder means and thereupon supplying power to said drive means to initiate movement from an initial starting position, said means provided for operatively coupling said drive means to said ram including an arm pivotally secured to said base support member intermediate the ends thereof, one end of said arm being operatively coupled to said ram, a closed loop cam surface formed in the opposite end of said arm, and a cam member engageable with said closed loop cam surface and connected to said drive means for rotation therewith, whereby rotation of said cam in engagement with said closed loop cam surface will produce rocking of said arm and correspondingly linear movement of said ram, said closed loop cam surface being of an elongate, oval configuration having a first dwell portion at the portion thereof corresponding to the lowermost point in the path of travel of said ram, thereby enabling the dies to apply pressure to the sheet material therebetween for a predetermined time interval so that the sheet material will flow during embossment, and a second dwell portion corresponding to the uppermost point in the path of travel of said ram to maintain said ram in said starting position at the end of the embossing cycle.

* * * * *